US006535055B2

(12) United States Patent
Teel et al.

(10) Patent No.: US 6,535,055 B2
(45) Date of Patent: Mar. 18, 2003

(54) PASS DEVICE LEAKAGE CURRENT CORRECTION CIRCUIT FOR USE IN LINEAR REGULATORS

(75) Inventors: John C. Teel, Plano, TX (US); David Grant, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/097,976

(22) Filed: Mar. 14, 2002

(65) Prior Publication Data

US 2002/0130709 A1 Sep. 19, 2002

Related U.S. Application Data

(60) Provisional application No. 60/277,131, filed on Mar. 19, 2001.

(51) Int. Cl.[7] ..... G05F 1/10

(52) U.S. Cl. ..... 327/540

(58) Field of Search ..... 327/530, 534, 327/535, 537, 538, 540, 541, 542, 543, 544, 545, 546

(56) References Cited

U.S. PATENT DOCUMENTS

| | | | | |
|---|---|---|---|---|
| 5,867,015 A | * | 2/1999 | Corsi et al. | 323/316 |
| 6,188,211 B1 | * | 2/2001 | Rincon-Mora et al. | 323/280 |
| 2002/0118568 A1 | * | 8/2002 | Tanzawa | 365/185.11 |

* cited by examiner

*Primary Examiner*—Jeffrey Zweizig
(74) *Attorney, Agent, or Firm*—Alan K. Stewart; W. James Brady, III; Frederick J. Telecky, Jr.

(57) ABSTRACT

The leakage current correction circuit uses a dummy device Mleak to detect leakage current. The dummy device is a scaled down version of the pass element Mpass. A current router is used to either gain up the dummy leakage current and apply it to the output Vout or simply dump the small un-gained current to ground GND.

16 Claims, 1 Drawing Sheet

PASS DEVICE LEAKAGE CURRENT CORRECTION CIRCUIT FOR USE IN LINEAR REGULATORS

This application claims priority under 35 USC 119 (e) (1) of provisional application No. 60/277,131 filed Mar. 19, 2001.

FIELD OF THE INVENTION

This invention generally relates to electronic systems and in particular it relates to pass device leakage current correction circuits for use in linear regulators.

BACKGROUND OF THE INVENTION

Because of the large physical size of the pass element that is used in linear regulators it can have a large amount of off-state leakage current especially at high temperatures. When no load is applied to the output this leakage current can cause the output to go out of regulation. And in fact may cause the output to rail to the input supply if the leakage current is significant. In the past, one possible solution was to simply require a minimum load current on the output; however, this is not a feasible solution for applications that operate in no-load or low-load conditions. Another possible solution is the use of a constant internal pull-down on the output. The problem with this technique is that the quiescent current significantly increases in order to provide this constant pull-down. Finally, one last alternative is the use of a current comparator. This circuit essentially compares the two current legs in the main differential amplifier. Under steady-state condition when the output is in regulation these currents should be equal. However, when the pass element leaks and the output goes out of regulation these currents are no longer equal. A simple current comparator can be used to gain up this differential current and apply it to the output.

SUMMARY OF THE INVENTION

The leakage current correction circuit uses a dummy device to detect leakage current. The dummy device is a scaled down version of the pass element. A current router is used to either gain up the dummy leakage current and apply it to the output or simply dump the small un-gained current to ground.

DETAILED DESCRIPTION OF PREFERRED EMBODIMENTS

Figure 1:
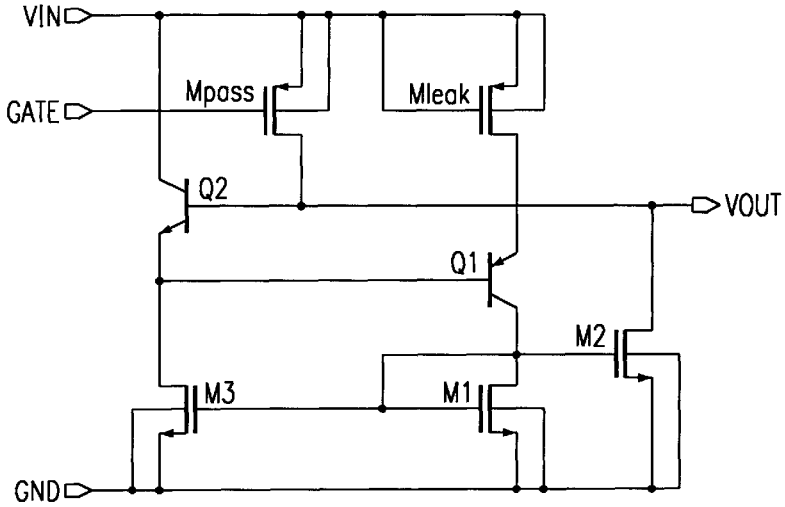
FIG. 1 is a schematic circuit diagram of a first preferred embodiment leakage current correction circuit.
Figure 2:
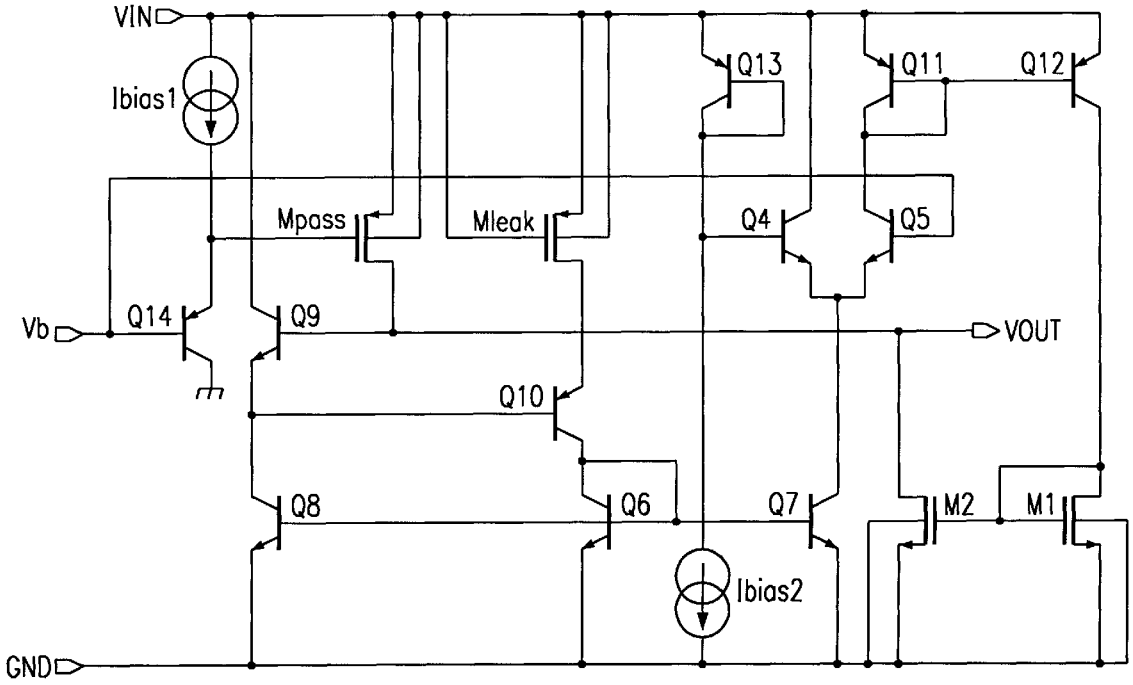
FIG. 2 is a schematic circuit diagram of a second preferred embodiment leakage current correction circuit.

The preferred embodiment circuits of FIGS. 1 and 2 use a dummy device Mleak to detect leakage current. The dummy device Mleak is a scaled down version of the pass element Mpass (for example 100:1). It then uses a current router to either gain up the dummy leakage current and apply it to the output Vout or simply dump the small un-gained current to ground GND.

The first preferred embodiment shown in FIG. 1 includes PMOS transistors Mpass and Mleak; NMOS transistors M1, M2, and M3; bipolar transistors Q1 and Q2; input supply VIN; ground GND; gate bias GATE; and output Vout. The circuit of FIG. 1 uses a dummy device Mleak to apply a constant pull-down on the output Vout. The advantage of this circuit over prior art constant pull-down circuits is that it only applies this pull-down current if the pass device is actually leaking (in this particular process only certain process corners suffer from this leakage). Device Mleak is the dummy device that is matched to the primary pass device Mpass. Any leakage current in this device is gained up by the current mirrors M1 and M2 and applied to the output Vout. Transistors Q1 and Q2 are simply used to cascode the drain of the dummy device Mleak at the nominal output voltage of the regulator so that the VDS (drain-to-source) voltages of the dummy and pass elements Mleak and Mpass match.

In the second preferred embodiment shown in FIG. 2, a differential current routing circuit is used. Instead of the dummy device leakage current always being pulled from the output, as in the circuit of FIG. 1, it is either gained up and pulled from the output Vout or not gained up and simply pulled from the input supply VIN depending on whether or not the output load is greater than the pass element leakage current. The circuit of FIG. 2 only applies the pull-down current when needed and is also inherently stable. This is an advantage over prior art solutions that are either always on (large quiescent current) or highly non-linear with a large open-loop gain (potentially unstable).

The second preferred embodiment shown in FIG. 2 includes PMOS transistors Mpass and Mleak; NMOS transistors M1 and M2; bipolar transistors Q4–Q14; current sources Ibias1 and Ibias2; bias voltage Vb; input supply VIN; ground GND; and output Vout. In the circuit of FIG. 2, an emitter-coupled pair Q4 and Q5 is used to compare a reference Q13, which is a diode drop below the input supply VIN, to a diode drop (transistor Q14) below the pass element gate voltage. The leakage current of the dummy device Mleak is mirrored around transistors Q6 and Q7 thus providing the tail current source for the emitter-coupled pair Q4 and Q5. This circuit works because if the condition occurs where the leakage current causes the output Vout to go above the regulation voltage then the gate of the pass-element Mpass is pulled up to the input supply VIN by the primary control feedback loop in an effort to turn off the pass device Mpass. When this occurs the current routing differential amplifier slews one way and all of the leakage current is gained up by current mirrors Q11, Q12, M1, and M2, and pulled from the output Vout. This final version introduces no offset and the output voltage remains in precise regulation over large leakage currents, loads, and temperatures.

The preferred embodiment circuit of FIG. 2 offers several advantages over prior art techniques. First, it only applies a pull-down to the output when required. Prior art solutions typically apply a constant pull-down current; however, this solution only applies a current when the device is actually leaking (via dummy device). Also, if an external load is applied, the circuit does not apply the pull-down current because it is not required. The circuit is also a linear well-behaved circuit that is in fact very stable. Also, as compared to the prior art current comparator solution, this new technique induces no offset voltage on the output. The current comparator method is highly non-linear and essentially goes from an off state to a full-on state and also has a large amount of gain. This type of prior art circuit has a high probability of instability. However, the preferred embodiment technique is very stable and has no high impedance nodes thus allowing the output capacitor to act as the compensation capacitor for this feedback loop.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A circuit comprising:

a primary pass device;

a dummy device that is matched to the primary pass device, and a voltage across the dummy device is matched to the primary device; and a current mirror coupled to the dummy device and to the primary pass device for compensating a leakage current in the primary pass device.

2. The circuit of claim 1 further comprising:

a first transistor coupled between the dummy device and the current mirror; and a second transistor coupled to a control node of the first transistor, and a control node of the second transistor is coupled to the primary pass device, whereby the voltage across the dummy device is matched to the primary device.

3. The circuit of claim 2 wherein the current mirror comprises:

a third transistor coupled to the first transistor; and a fourth transistor coupled to the primary pass device and having a control node coupled to a control node of the third transistor and coupled to the first transistor.

4. The circuit of claim 3 further comprising a fifth transistor coupled to the second transistor and having a control node coupled to the control node of the third transistor.

5. The circuit of claim 1 wherein the primary pass device and the dummy device are transistors.

6. The circuit of claim 1 wherein the primary pass device and the dummy device are MOSFET transistors.

7. The circuit of claim 2 wherein the first and second transistors are bipolar transistors.

8. A method for compensating a leakage current in a pass device comprising:

matching a dummy device to the pass device;

matching a voltage across the dummy device to the pass device;

mirroring a current from the dummy device to the pass device such that the leakage current is compensated.

9. The method of claim 8 wherein the voltage across the dummy device is matched to the pass device by cascading a drain of the dummy device at a drain voltage of the pass device.

10. The method of claim 8 wherein the pass device and the dummy device are MOSFET transistors.

11. A circuit comprising:

a primary pass device;

a dummy device that is matched to the primary pass device, and a voltage across the dummy device is matched to the primary device; and a differential current routing circuit coupled between the dummy device and to the primary pass device for compensating a leakage current in the primary pass device.

12. The circuit of claim 11 further comprising a current mirror coupled to the dummy device for supplying a tail current for the differential current routing circuit.

13. The circuit of claim 12 wherein the differential current routing circuit comprises:

a differential pair;

a first control node of the differential pair coupled to a reference node;

a second control node of the differential pair coupled to a control node of the primary pass device through a diode.

14. The circuit of claim 13 wherein the diode is a base-to-emitter junction of a bipolar transistor.

15. The circuit of claim 13 wherein the reference node is coupled to a supply node through a diode.

16. The circuit of claim 13 wherein the differential pair comprises an emitter-coupled pair of bipolar transistors.

* * * * *